US007543648B2

(12) United States Patent
Hill et al.

(10) Patent No.: US 7,543,648 B2
(45) Date of Patent: Jun. 9, 2009

(54) SYSTEM AND METHOD UTILIZING A COMPLIANT WELL SCREEN

(75) Inventors: Stephen D. Hill, Pearland, TX (US); Lawrence J. Leising, Missouri City, TX (US); Frank Espinosa, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 329 days.

(21) Appl. No.: 11/555,841

(22) Filed: Nov. 2, 2006

(65) Prior Publication Data

US 2008/0105437 A1 May 8, 2008

(51) Int. Cl.
*E21B 43/08* (2006.01)
*E21B 43/10* (2006.01)

(52) U.S. Cl. ..... 166/369; 166/227; 166/381

(58) Field of Classification Search ..... 166/380, 166/369, 207, 227, 381
See application file for complete search history.

(56) References Cited

U.S. PATENT DOCUMENTS

| | | | | |
|---|---|---|---|---|
| 3,099,318 | A * | 7/1963 | Miller et al. | 166/227 |
| 3,275,785 | A | 9/1966 | Wilson | |
| 3,469,609 | A | 9/1969 | Smith | |
| 3,875,977 | A | 4/1975 | Colburn | |
| 4,314,129 | A | 2/1982 | Wilson | |
| 6,012,522 | A * | 1/2000 | Donnelly et al. | 166/276 |
| 6,932,159 | B2 * | 8/2005 | Hovem | 166/296 |
| 7,055,598 | B2 | 6/2006 | Ross | |
| 7,108,062 | B2 * | 9/2006 | Castano-Mears et al. | 166/227 |
| 7,318,481 | B2 * | 1/2008 | Richard | 166/369 |
| 2003/0062170 | A1 * | 4/2003 | Slack | 166/377 |
| 2005/0109510 | A1 * | 5/2005 | Chen et al. | 166/297 |
| 2006/0015725 | A1 | 1/2006 | Voice | |
| 2006/0096761 | A1 | 5/2006 | Rouse | |
| 2006/0144596 | A1 | 7/2006 | Oyeneyin | |

* cited by examiner

*Primary Examiner*—Hoang Dang
(74) *Attorney, Agent, or Firm*—Rodney Warfford; David Cate; Robin Naua

(57) ABSTRACT

A system and method is provided for filtering in a wellbore during various well related operations while limiting the potential for plugging. A well screen is used for filtering particulates from a fluid at a wellbore location. To remove accumulated material and avoid plugging, the well screen may be flexed via pressure differentials created across the well screen. The flexing of the well screen breaks free the accumulated materials, thereby avoiding premature job failure.

21 Claims, 4 Drawing Sheets

SYSTEM AND METHOD UTILIZING A COMPLIANT WELL SCREEN

BACKGROUND

In many wellbore applications, sand laden fluids are filtered to return a clean fluid to the surface or to dehydrate a slurry at a desired location in a wellbore. The filtering is performed by a filtering media created from a wire wrapped or wire mesh structure. This type of filtering media is susceptible to plugging over a period time which can cause premature job failure.

Attempts have been made to reduce plugging by using powered tools associated with the filtering media. For example, screens have been designed with rotatable sleeves to help reduce plugging. Other screens utilize movable components that can be actuated to close off the screen during certain operations. However, such devices have limited effectiveness. Additionally, these devices tend to be complex, expensive devices requiring a power source for operation.

SUMMARY

In general, the present invention provides a system and method of filtering in a wellbore during various well related operations. A well screen is combined with a tool string for movement downhole into a wellbore. The well screen may be flexed via pressure differentials created across the well screen. For example, pressure inputs create pressure differentials able to flex the well screen between a normal mode and one or more deflection modes. Examples of deflection modes comprise a radially inward deflection mode and/or a radially outward deflection mode. Once the actuating pressure differential is diminished, the well screen automatically returns to the normal mode. The flexing of the well screen is used for adjusting flow gap size and for removing accumulated materials to unplug the well screen for continued use, thereby avoiding premature job failure.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and methodology for filtering particulates from a fluid stream at a location within a wellbore. A compliant well screen is moved downhole into a wellbore for use in one or more well related operations. The well screen is compliant and cooperates with the overall system in a manner that enables removal of or prevention of plugging along the well screen. The well screen also can be used to facilitate downhole operations, such as the dehydration of a slurry in the wellbore. The compliant well screen is flexed between different modes of deflection via differential pressures across the well screen. For example, the pressure inputs resulting from the differential pressures across the well screen can be used to flex the well screen between a normal or intermediate mode and, for example, a radially inward mode of deflection or a radially outward mode of deflection.

Figure 1:
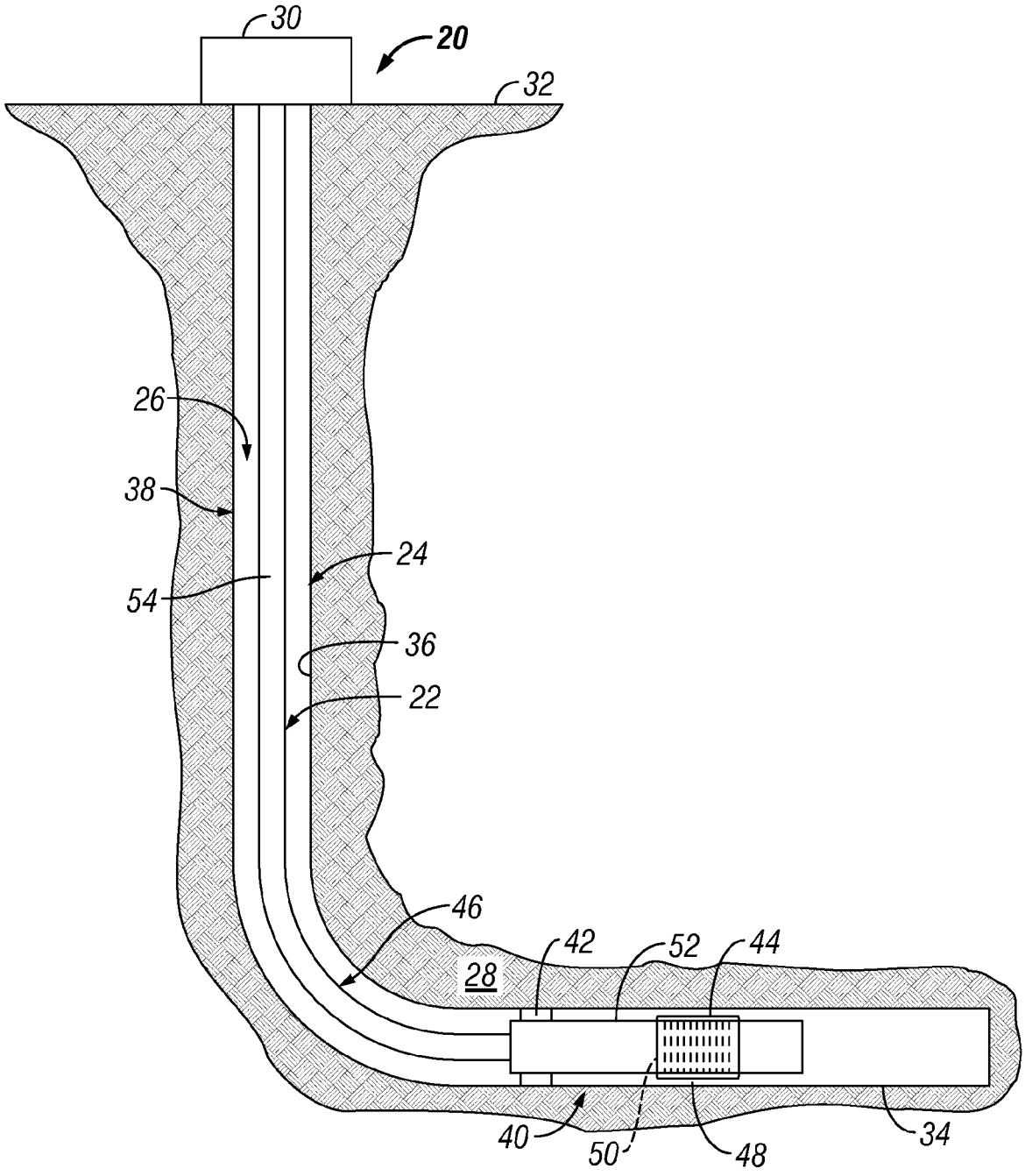
FIG. 1 is a front elevation view of a wellbore assembly disposed in a wellbore, according to an embodiment of the present invention.

Referring generally to FIG. 1, a system 20 is illustrated according to an embodiment of the present invention. In the particular embodiment illustrated, system 20 comprises a wellbore assembly 22 disposed in a well 24 that comprises a wellbore 26 drilled into a formation 28. Formation 28 may hold desirable production fluids, such as oil. Wellbore assembly 22 extends downwardly into wellbore 26 from, for example, a wellhead 30 that may be positioned along a surface 32, such as the surface of the earth or a seabed floor. The wellbore 26 may comprise open hole sections, e.g. open hole section 34, cased sections lined by a casing 36, or a combination of cased sections and open hole sections. Additionally, wellbore 26 may be formed as a vertical wellbore or a deviated, e.g. horizontal, wellbore. In the embodiment illustrated in FIG. 1, wellbore 26 comprises a vertical section 38 and a deviated section 40 which is illustrated as generally horizontal. One or more packers 42 also may be used with or included as part of wellbore assembly 22 to seal off desired sections of wellbore 26.

In the example illustrated, wellbore assembly 22 further comprises a well screen 44 that is carried downhole into wellbore 26 on a tool string 46. Well screen 44 is a compliant well screen that may be moved between a plurality of deflection modes via pressure differentials created between an exterior region 48 surrounding well screen 44 and an interior region 50 within well screen 44 and tool string 46. Tool string 46 may be formed in a variety of configurations and with a variety of components depending on the specific well application for which it is designed. In some operations, for example, tool string 46 comprises a bottom hole assembly 52 coupled to a tubing 54. However, other components and component arrangements can be used with well screen 44 to facilitate a variety of well related operations.

Figure 2:
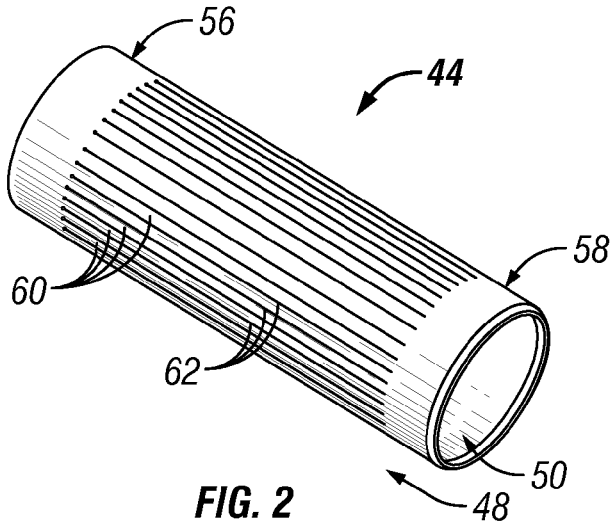
FIG. 2 is an isometric view of a well screen, according to an embodiment of the present invention.

One embodiment of well screen 44 is illustrated in FIG. 2. In this embodiment, well screen 44 is generally tubular in shape and able to undergo deflections away from a normal mode, such deflections being radially inward and/or radially outward deflections depending on the pressure inputs applied to the well screen. The illustrated well screen 44 comprises a first well screen end 56 and a second well screen end 58. Well screen ends 56 and 58 are substantially rigid in the sense that the ends do not flex outwardly or inwardly when pressure differentials are applied between exterior region 48 and interior region 50. Extending between well screen ends 56 and 58 are a plurality of elongate members 60 separated by slots 62. The elongate members 60 extend in a longitudinal direction generally aligned with the axis of well screen 44.

The slots 62 provide gaps for fluid flow across well screen 44 from exterior region 48 to interior region 50 or from interior region 50 to exterior region 48. The gap size of slots 62 controls the size of particulars that are filtered from the flow of fluid. However, this gap size is adjusted as the compliant well screen 44 is transitioned between different deflection modes via flexing of elongate members 60 in, for example, a radially inward direction or a radially outward direction between screen ends 56 and 58.

Figure 3:
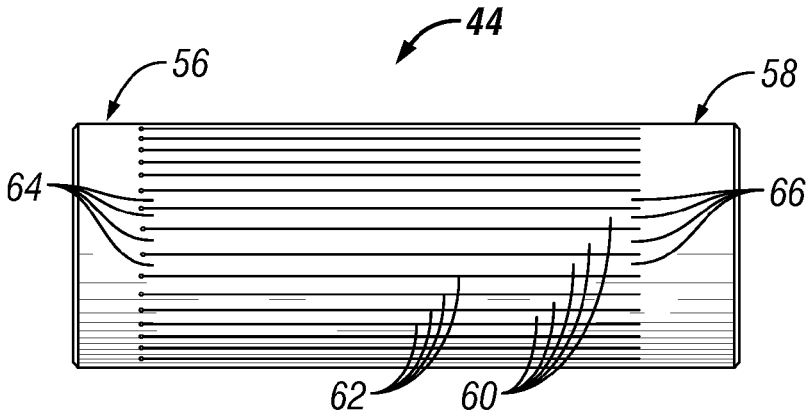
FIG. 3 is a side view of the well screen illustrated in FIG. 2, according to an embodiment of the present invention.

As further illustrated in FIG. 3, elongate members 60 may be formed as beams that extend in a generally linear and parallel arrangement between well screen ends 56 and 58. Each elongate member or beam 60 has linear ends 64, 66 affixed to well screen ends 56, 58, respectively. Thus, the linear ends 64, 66 of elongate members 60 are substantially fixed with respect to movement in a radial direction. However, the portion of elongate members 60 between ends 64, 66 can be flexed in a radially inward or a radially outward direction to change the gap size of slots 62. In the embodiment illustrated the design of elongate members 60 and slots 62 ensures the gap size is never reduced to zero. In other words, at least some fluid flow is allowed across well screen 44 between interior region 50 and exterior region 48 even when the well screen 44 is transitioned to a maximum deflection. It should also be noted that the amount of deflection, the pressure differential required to cause deflection, and the shape or pattern of deflection can be controlled by changing the length or cross-section of elongate members 60. Additionally, these compliancy characteristics also can be controlled by selecting the appropriate material composition of elongate members 60 for a given application. For example, a variety of steels, other metals, phenolics, composites and non-metallic materials can be used in the construction of well screen 44.

Figure 4:
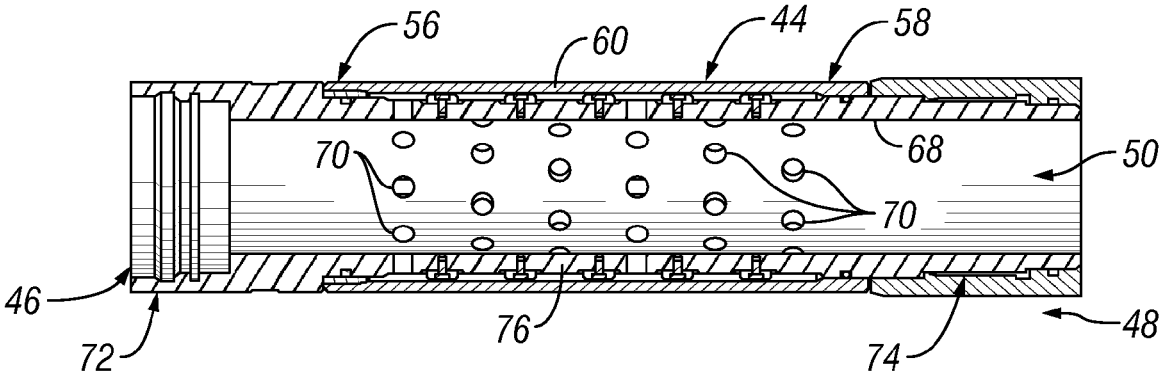
FIG. 4 is a cross-sectional view of a well screen mounted on a support structure, according to an embodiment of the present invention.

Well system 20 also may comprise a support structure 68 positioned to limit deflection of compliant well screen 44. One example of support structure 68 is illustrated in FIG. 4. In this embodiment, support structure 68 is positioned along an interior of well screen 44 to limit deflection of well screen 44 in a radially inward direction. However, alternate or additional support structures also can be located along an exterior of well screen 44 to limit deflection of well screen 44 in a radially outward direction. Additionally, support structure 68 may have a variety of other configurations that enable the limiting of well screen deflection.

In the specific example illustrated, support structure 68 comprises a tubular member having a plurality of radial openings 70 to accommodate fluid flow between exterior region 48 and interior region 50. Support structure 68 further comprises standard connection ends 72 and 74 that allow support structure 68 to be coupled to tool string 46. By way of example, standard connection ends 72 and 74 may comprise threaded connection ends or flange-style connection ends. Support structure 68 also comprises a tubular midsection 76 sized to fit within compliant well screen 44 so as to limit the radially inward deflection of well screen 44.

Figure 5:
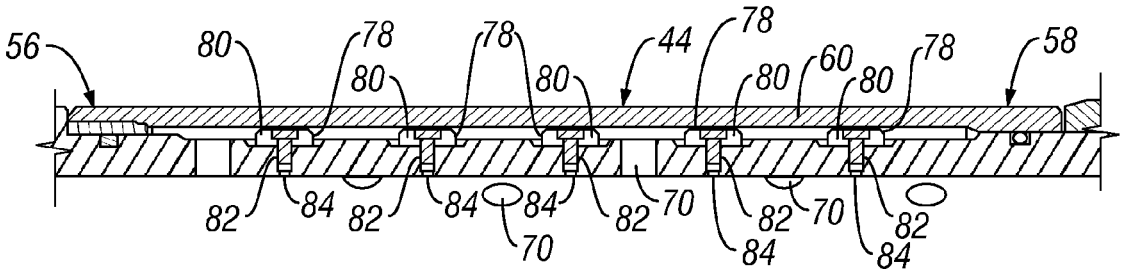
FIG. 5 illustrates an enlarged portion of the embodiment illustrated in FIG. 4.

As best illustrated in FIG. 5, support structure 68 may further comprise a plurality of support elements 78 positioned to block radially inward movement of well screen 44 at a predetermined limit. For example, support elements 78 may be sized to insure the maximum deflection of well screen 44 remains within the elastic limits of the elongate members 60. The maximum deflection within the elastic regime of elongate members 60 is a function of material choice as well as length of elongate members 60.

In the embodiment illustrated, support elements 78 are mounted to tubular midsection 76 and are interchangeable to enable adjustment of the maximum deflection limitation. By way of example, each support element 78 may comprise a cap 80 of predetermined thickness. The cap 80 is mounted to tubular midsection 76 by a fastener 82, such as a threaded fastener received in a threaded opening 84 formed in tubular midsection 76 of support structure 68. Accordingly, the maximum deflection limitation can be changed by unthreading each threaded fastener 82, removing each corresponding cap 80, and reattaching the same or different threaded fasteners 82 with alternate caps 80 of a different thickness.

In some embodiments, the compliant well screen 44 can deflect in both an expanding mode and a collapsing mode to remove accumulation and prevent plugging of well screen 44. The ability to deflect well screen 44 also facilitates a variety of well operations, such as dehydration of slurry in the wellbore during, for example, a gravel packing operation. The prevention of plugging is accomplished without employing any powered control mechanism downhole. Instead, elongate members 60 of well screen 44 are flexed upon application of sufficient pressure inputs created by internal and/or external pressure differentials formed along the well screen 44. The application of pressure differentials also alters slots 62 which, in turn, changes the gap size through which fluid flows through well screen 44. Pressure differentials may be generated by, for example, flow, mechanical crushing or drag resulting from movement of the bottom hole assembly 52, mechanical radial force from a tool having a sliding sleeve, or other mechanisms or procedures for developing pressure differentials.

Figure 6:
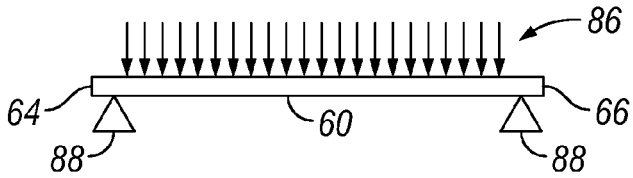
FIG. 6 is a schematic illustration of a well screen in a normal deflection mode, according to an embodiment of the present invention.

Until the pressure differential between exterior region 48 and interior region 50 is sufficiently great, elongate members 60 remain in an intermediate or normal mode, as illustrated schematically in FIG. 6. In this illustration, the orientation of the pressure differential is indicated by a plurality of arrows 86. The pressure differential acts on elongate members 60 which have ends 64, 66 held radially stationary by well screen ends 56, 58 as represented by triangles 88 in FIG. 6.

Figure 7:
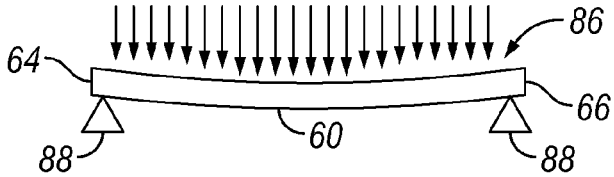
FIG. 7 is a schematic illustration of a well screen in a radially inward deflection mode, according to an embodiment of the present invention.

Once the predetermined differential pressure is reached as a result of fluid flow from the exterior annulus region 48 to the interior region 50 within the tool string, the elongate members or beams 60 collapse, as illustrated schematically in FIG. 7. The beams 60 collapse until the flexing is limited by support structure 68. As described above, the deflection is limited such that elongate members 60 remain in their elastic state and thus remain free to return to the intermediate mode illustrated in FIG. 6 after sufficient reduction of the pressure differential. This radially inward mode of deflection does not completely remove the gaps created by slots 62 and thus allows some liquid flow therethrough. The retained gaps enable slurry, for example, to continue to dehydrate over a given period of time.

Figure 8:
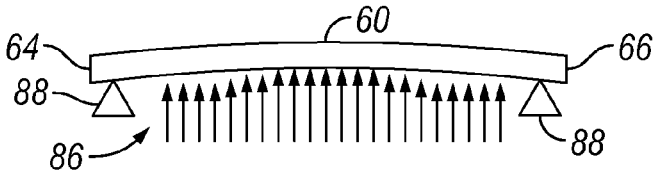
FIG. 8 is a schematic illustration of a well screen in a radially outward deflection mode, according to an embodiment of the present invention.

The radially inward deflection mode also forces the elongate members 60 into closer proximity with each other, thereby crushing particles that are within the gaps or slots 62 between elongate members 60. Upon sufficient reduction or removal of the pressure differential across well screen 44, the well screen 44 returns to its intermediate deflection mode. Fluid flow can then be directed into interior region 50 within tool string 46 to create an outward flow of fluid through well screen 44 from interior region 50 to exterior region 48. The fluid flow can be directed to interior region 50 via flow through coiled tubing or jointed pipe of system 20, for example. This backflow can be used to create a pressure differential able to transition the well screen to a radially outward deflection mode in which elongate members 60 are bowed radially outwardly, as illustrated schematically in FIG. 8. The outward flexing of well screen 44 increases the gap size by opening slots 62 and further facilitates the washing away of any remaining debris previously trapped in the gaps between elongate members 60. Upon removal or reduction of the pressure differential, well screen 44 returns to its intermediate deflection mode.

The ability to flex well screen 44 between radially inward and/or outward deflection modes and to control the gap size between elongate members 60 effectively allows well screen 44 to breathe by removing plugging proppant or other materials. Furthermore, the well screen gap size can be adjusted to an optimum size during usage of well screen 44 simply by using internal and external differential pressures across well screen 44. One result is an increase in running time for well screen 44 which, in turn, facilitates the performance and efficiency of well operations by reducing the running in and out of the wellbore to change screen assemblies.

In some well applications, the deflection due to expansion is controlled by pressure drop because flow to the interior of tool string 46 can either leave through well screen 44 or through the bottom of bottom hole assembly 52. In these embodiments, flushing at a predetermined, controlled rate provides the pressure differential needed to expand well screen 44 to the radially outward deflection mode.

Figure 9:
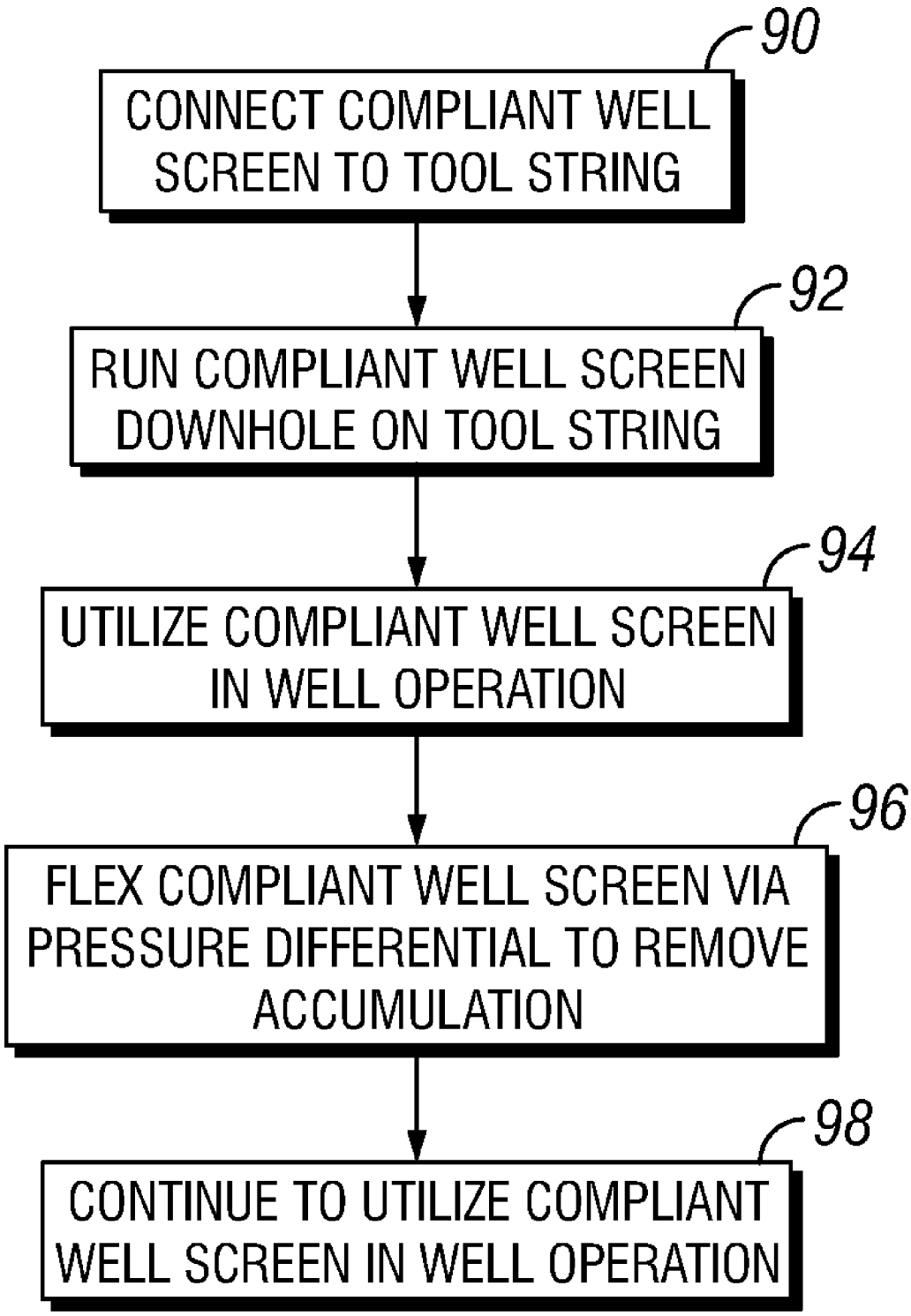
FIG. 9 is a flowchart illustrating utilization of a compliant well screen, according to an embodiment of the present invention.

Well system 20 can be designed for a variety of well related operations that can benefit from the ability to use simple pressure differentials in controlling gap size for conducting flow through the well screen 44 and in preventing plugging of the well screen 44. As illustrated by the flowchart of FIG. 9, the compliant well screen 44 can benefit a variety of well related operations. In operation, the compliant well screen 44 is initially connected to a tool string 46 designed for a specific well operation or operations, as indicated by block 90 in FIG. 9. The compliant well screen 44 is then run downhole into wellbore 26 on tool string 46, as indicated by block 92. Once well screen 44 is positioned at a desired location within wellbore 26, the well screen is utilized in the desired well operation, as indicated by block 94.

The utilization of compliant well screen 44 may be incorporated into a variety of well operations. For example, compliant well screen 44 can be used in a producing well or to facilitate the return of clean fluid to a surface location in a gravel packing operation. Compliant well screen 44 also can be used to facilitate a fracturing operation or a well stimulation operation. Additionally, compliant well screen 44 can be used in a clean-out operation or to facilitate the reverse circulation of fluid through a bottom hole assembly. Furthermore, the well screen 44 can be flexed to create a desired gap size and/or to remove accumulation along the well screen while the well screen is moved along wellbore 26. For example, well screen 44 can be flexed to prevent plugging and/or to adjust gap size as the well screen is run in hole, pulled out of hole, or moved between wellbore zones.

In any of these operations, well screen 44 is flexed via a created pressure differential to remove accumulation and prevent plugging and/or to adjust the gap size between elongate members 60, as indicated by block 96. During or after flexing of compliant well screen 44 to a desired deflection mode or modes, the well operation is continued without any need to pull well screen 44 from the wellbore, as represented by block 98. Accordingly, no separately powered tools are required to clean the well screen, and well screen 44 can be operated with simple pressure differentials between an exterior and an interior of the well screen.

It should be noted that well system 20 may have a variety of configurations and components for use in many types of well operations. Additionally, the diameter, length, shape and materials of well screen 44 can be adjusted to accommodate system requirements, environmental factors or other design considerations.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for filtering in a wellbore, comprising:

a tool string that can be moved downhole into a wellbore; and a well screen coupled to the tool string, the well screen being selectively flexible away from a normal mode via pressure inputs that transition the well screen to a deflection mode altered from the normal mode, the well screen automatically returning to the normal mode upon removal of the pressure inputs, wherein the deflection mode is a radially outward deflection mode.

2. The system as recited in claim 1, wherein the deflection mode is a radially inward deflection mode.

3. The system as recited in claim 1, wherein the deflection mode comprises a plurality of deflection modes including the radially inward deflection mode and a radially outward deflection mode, the normal mode being intermediate the radially inward deflection mode and the radially outward deflection mode.

4. A system for filtering in a wellbore, comprising:

a tool string that can be moved downhole into a wellbore; and a well screen coupled to the tool string, the well screen being selectively flexible away from a normal mode via pressure inputs that transition the well screen to a deflection mode altered from the normal mode, the well screen automatically returning to the normal mode upon removal of the pressure inputs, wherein the well screen comprises a first end, a second end, and a plurality of elongate members separated by slots extending from the first end to the second end.

5. The system as recited in claim 4, wherein the size of the slots is adjusted by the pressure inputs.

6. The system as recited in claim 4, wherein the plurality of elongate members are bowed in a radially inward direction when the well screen is in the radially inward deflection mode.

7. The system as recited in claim 4, wherein the plurality of elongate members are bowed in a radially outward direction when the well screen is in the radially outward deflection mode.

8. A system for filtering in a wellbore, comprising:

a tool string that can be moved downhole into a wellbore;

a well screen coupled to the tool string, the well screen being selectively flexible away from a normal mode via pressure inputs that transition the well screen to a deflection mode altered from the normal mode, the well screen automatically returning to the normal mode upon removal of the pressure inputs; and a support structure positioned to limit deflection of the well screen, wherein the support structure comprises a plurality of support elements that can be interchanged with other support elements to adjust a limit on deflection.

9. A method of filtering in a wellbore, comprising:

providing a well screen with flexible members able to control a gap size for conducting a fluid flow therethrough;

coupling the well screen to a tool string;

delivering the well screen to a wellbore location; and controlling the gap size by flexing the flexible members in a radially inward direction during flow of fluid from an annulus surrounding the well screen to an interior of the tool string.

10. The method as recited in claim 9, further comprising maintaining a flow area for fluid to flow through the well screen when the well screen is in a fully deformed position.

11. The method as recited in claim 9, wherein controlling comprises flexing the flexible members in a radially outward direction by flowing a fluid into an interior of the well screen to unplug the well screen.

12. A method of filtering in a wellbore, comprising:

providing a well screen with flexible members able to control a gap size for conducting a fluid flow therethrough;

coupling the well screen to a tool string;

delivering the well screen to a wellbore location; and controlling the gap size by flexing the flexible members via a pressure differential across the well screen, wherein providing comprises providing the flexible members in the form of a plurality of beams extending in a longitudinal direction and separated by slots that are variable to change the gap size.

13. The method as recited in claim 12, further comprising limiting deflection of the plurality of beams so as to remain in an elastic deformation regime of the beams.

14. The method as recited in claim 12, further comprising limiting deflection of the plurality of beams in a radially inward direction.

15. The method as recited in claim 12, further comprising forcing particulates from the slots by flexing the plurality of beams in a radially inward direction.

16. The method as recited in claim 12, further comprising adjusting the flexibility of the screen via selection of beam length for the plurality of beams.

17. The method as recited in claim 12, further comprising adjusting the flexibility of the screen via selection of material properties for the plurality of beams.

18. A method, comprising:

running a well screen downhole on a tool string;

removing accumulation on the well screen by flexing the well screen with a pressure differential created across the well screen; and utilizing the well screen in a wellbore operation, wherein removing comprises removing the accumulation while the well screen is being moved along the wellbore.

19. The method as recited in claim 18, wherein utilizing comprises utilizing the well screen in a fracturing operation, in a gravel packing operation, in a clean-out operation, for reverse circulation through a bottom hole assembly, or a producing well.

20. The method as recited in claim 18, wherein utilizing comprises utilizing the well screen in a well stimulation operation.

21. A method, comprising:

running a well screen downhole on a tool string;

removing accumulation on the well screen by flexing the well screen with a pressure differential created across the well screen; and utilizing the well screen in a wellbore operation, wherein removing comprises flexing a plurality of beams to alter a gap size between individual beams of the plurality of beams.

* * * * *